US009853397B1

(12) United States Patent
Bucher et al.

(10) Patent No.: US 9,853,397 B1
(45) Date of Patent: Dec. 26, 2017

(54) PLUGGABLE MODULE HAVING PULL TETHER FOR LATCH RELEASE

(71) Applicant: TYCO ELECTRONICS CORPORATION, Berwyn, PA (US)

(72) Inventors: Alan Weir Bucher, Manheim, PA (US); Alex Michael Sharf, Harrisburg, PA (US)

(73) Assignee: TE CONNECTIVITY CORPORATION, Berwyn, PA (US)

( * ) Notice: Subject to any disclaimer, the term of this patent is extended or adjusted under 35 U.S.C. 154(b) by 0 days.

(21) Appl. No.: 15/267,281

(22) Filed: Sep. 16, 2016

(51) Int. Cl.
*H01R 13/627* (2006.01)
*H01R 13/633* (2006.01)
*H01R 13/6581* (2011.01)

(52) U.S. Cl.
CPC ..... *H01R 13/6335* (2013.01); *H01R 13/6272* (2013.01); *H01R 13/6581* (2013.01)

(58) Field of Classification Search
CPC ..... H01R 13/6275; H01R 13/6276; H01R 13/6277; H01R 13/6278; H01R 13/6271; H01R 13/6582; H01R 13/6335; H01R 13/6594
USPC ..... 439/358, 350, 352, 353, 483, 484, 607.2
See application file for complete search history.

(56) References Cited

U.S. PATENT DOCUMENTS

| | | | | |
|---|---|---|---|---|
| 6,464,403 | B1 * | 10/2002 | Koch | G02B 6/3893 385/139 |
| 6,538,882 | B2 | 3/2003 | Branch et al. | |
| 6,908,323 | B2 * | 6/2005 | Ice | G02B 6/4201 361/728 |
| 7,402,070 | B1 * | 7/2008 | Wu | H01R 13/635 439/152 |
| 7,445,485 | B1 * | 11/2008 | Wu | H01R 13/514 439/160 |
| 7,651,361 | B2 | 1/2010 | Henry et al. | |
| 8,169,783 | B2 | 5/2012 | Phillips et al. | |
| 8,435,062 | B2 * | 5/2013 | Lange | H01R 13/6272 439/350 |
| 9,195,013 | B2 | 11/2015 | Yoshizaki | |

* cited by examiner

*Primary Examiner* — Hae Moon Hyeon

(57) ABSTRACT

A pluggable module includes a plug body, a deflectable beam, and a tether. A rear end of the plug body is removably receivable in a module cavity of a cage member. The deflectable beam extends from a fixed end to a free end that is spaced apart from the plug body by a clearance gap. The deflectable beam includes a catch feature engaging a complementary catch feature of the cage member to secure the pluggable module in the module cavity. The tether extends through the plug body within a tether channel. A mounting end of the tether is secured to the deflectable beam and a handle of the tether projects beyond the front end of the plug body. Frontward movement of the handle deflects the deflectable beam into the clearance gap for disengaging the catch features to allow removal of the pluggable module from the module cavity.

20 Claims, 5 Drawing Sheets

PLUGGABLE MODULE HAVING PULL TETHER FOR LATCH RELEASE

BACKGROUND OF THE INVENTION

The subject matter herein relates generally to pluggable modules for communication systems.

At least some known communication systems include receptacle assemblies, such as input/output (I/O) connector assemblies, that are configured to receive a pluggable connector module and establish a communicative connection between the pluggable connector module and an electrical communication connector of the receptacle assembly. As one example, a known receptacle assembly includes a cage member that is mounted to a circuit board, and the electrical communication connector is disposed within the cage member. The cage member is configured to removably receive a small form-factor (SFP) pluggable connector module in an elongated cavity of the cage member. The pluggable connector module and the electrical communication connector have respective electrical contacts that engage one another to establish a communicative connection.

Specialty pluggable modules are used for shielding and/or testing purposes for the communication system. Testing pluggable modules may be used for diagnostic testing of the electrical communication connector within the cage member. Shielding pluggable modules may be used for sealing an elongated cavity of the cage member that does not have a pluggable connector module therein. For example, the cage member may align with, and optionally extend through an opening in a panel of a device. The electrical communication connector is within an interior of the device, and the pluggable connector module is received into the elongated cavity through the opening of the panel from an exterior region outside of the device. When the pluggable connector module is not disposed within the elongated cavity, the shielding pluggable module is loaded into the elongated cavity to plug the elongated cavity to contain electromagnetic interference (EMI) within the cage member and/or the device, and optionally the shielding pluggable module may be used to shield the electrical communication connector and other electronic components within the device from EMI originating outside of the device. The specialty modules, including the testing modules and the shielding modules, are designed to be compatible with standard receptacle assemblies. For example, the specialty modules have similar form factors to the I/O pluggable connector modules.

The specialty pluggable modules, as well as the I/O pluggable connector modules, are typically retained in the elongated cavities via the use of releasable latching mechanisms. However, conventional latching mechanisms for pluggable modules may be rather complicated, involving many discrete components that interact with each other to selectively unlatch the pluggable module from the cage member. The complicated latching mechanisms with numerous components can be costly in regard to both parts and assembly, and may be prone to malfunction due to the multitude of interacting components.

Accordingly, there is a need for pluggable modules of a communication system that have an improved releasable latching mechanism.

BRIEF DESCRIPTION OF THE INVENTION

In one embodiment, a pluggable module is provided that includes a plug body, a deflectable beam, and a tether. The plug body extends between a front end and an opposite rear end. The rear end is removably receivable in a module cavity of a cage member. The deflectable beam extends between a fixed end that is fixed to the plug body and a free end that is spaced apart from an outer wall of the plug body by a clearance gap. The deflectable beam includes a catch feature configured to engage a complementary catch feature of the cage member to secure the pluggable module in the module cavity. The tether is disposed within a tether channel of the plug body that extends through the plug body to the clearance gap. The tether has a mounting end secured to the deflectable beam and a handle projecting beyond the front end of the plug body. Movement of the handle in a frontward direction deflects the deflectable beam into the clearance gap such that the catch feature of the deflectable beam is moved for disengaging the complementary catch feature of the cage member to allow the pluggable module to be removed from the module cavity.

In another embodiment, a pluggable module is provided that includes a plug body, a deflectable beam, and a tether. The plug body extends between a front end and an opposite rear end. The rear end is removably receivable in a module cavity of a cage member. The deflectable beam extends between a fixed end that is fixed to the plug body and a free end that is spaced apart from an outer wall of the plug body by a clearance gap. The deflectable beam includes a catch feature configured to engage a complementary catch feature of the cage member to secure the pluggable module in the module cavity. The tether is disposed within a tether channel of the plug body that extends along a curved path through the plug body between a first opening at the clearance gap and a second opening at the front end of the plug body. The tether has a mounting end extending from the first opening and secured to the deflectable beam. The tether further includes a handle extending from the second opening at the front end of the plug body. Movement of the handle in a frontward direction deflects the deflectable beam into the clearance gap such that the catch feature of the deflectable beam is moved for disengaging the complementary catch feature of the cage member to allow the pluggable module to be removed from the module cavity.

In a further embodiment, a pluggable module is provided that includes a plug body and a tether. The plug body extends between a front end and an opposite rear end. The rear end is removably receivable in a module cavity of a cage member. The rear end of the plug body is closed and defines a rear wall. The plug body includes a deflectable beam that is integral to the plug body. The deflectable beam extends from the plug body between a fixed end attached to the plug body and a free end spaced apart from an outer wall of the plug body by a clearance gap. The deflectable beam includes a catch feature that is configured to engage a complementary catch feature of the cage member to secure the pluggable module in the module cavity. The tether is disposed within a tether channel of the plug body that extends through the plug body to the clearance gap. The tether has a mounting end secured to the deflectable beam and a handle projecting beyond the front end of the plug body. Movement of the handle in a frontward direction deflects the deflectable beam into the clearance gap such that the catch feature of the deflectable beam is moved for disengaging the complementary catch feature of the cage member to allow the pluggable module to be removed from the module cavity.

DETAILED DESCRIPTION OF THE INVENTION

Embodiments set forth herein include pluggable modules with releasable latching mechanisms used for selectively releasing the pluggable modules from cage members of I/O receptacle assemblies to allow the pluggable modules to be removed from elongated cavities of the cage members. For example, the pluggable modules include a plug body with a deflectable beam that engages a catch feature of the cage member to secure the corresponding pluggable module in the elongated cavity. The pluggable modules further include a tether that is coupled at one end to the deflectable beam. The tether extends through the plug body out of the elongated cavity such that an opposite end of the tether is exposed to an operator. In one or more embodiments, manipulation of the exposed end of the tether by the operator pulling on the tether causes the deflectable beam to deflect due to tension in the tether. The deflectable beam disengages the catch feature of the cage member upon deflecting, allowing the operator to pull the pluggable module out of the elongated cavity with a reasonable amount of force. The releasable latching mechanisms described herein may have fewer components and/or may be more reliable than conventional releasable latching mechanisms for pluggable modules.

Figure 1:
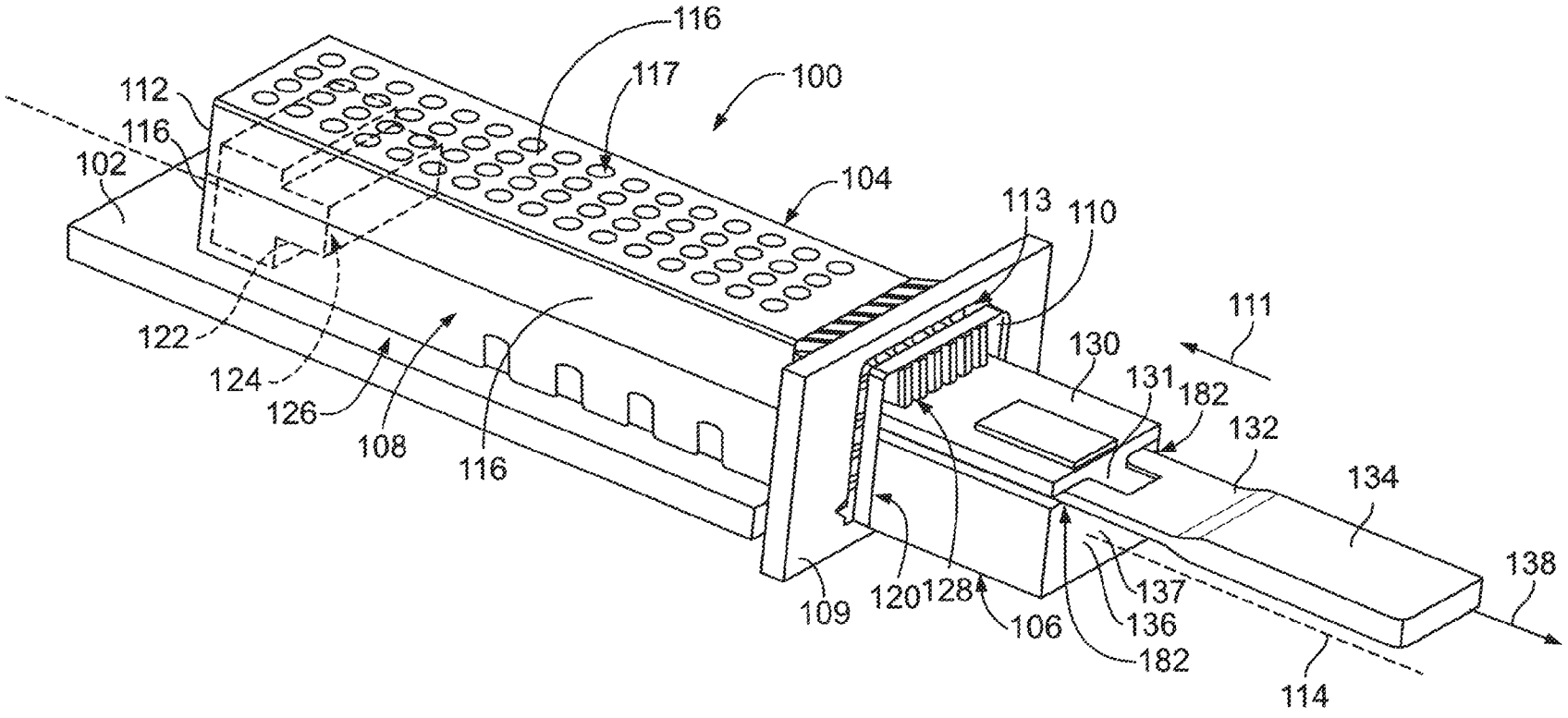
FIG. 1 is a front perspective view of a communication system in accordance with an embodiment.

FIG. 1 is a front perspective view of a communication system 100 in accordance with an embodiment. The communication system 100 includes a circuit board 102, a receptacle assembly 104 mounted to the circuit board 102, and a shielding pluggable module 106 (sometimes simply referred to as pluggable module 106) that is configured to be received in the receptacle assembly 104. The circuit board 102 may be a daughter card or a mother board and include conductive traces (not shown) extending therethrough. The communication system 100 may be part of or used with telecommunication systems or devices. For example, the communication system 100 may be part of or include a switch, router, server, hub, network interface card, or storage system. The shielding pluggable module 106 may be substitutable for an input/output (I/O) pluggable connector module that communicatively couples to the receptacle assembly 104, such as to a communication connector 122 of the receptacle assembly 104, to send and/or receive data signals with components of the communication system 100. In various embodiments, the shielding pluggable module 106 does not transmit data signals with the communication connector 122 of the receptacle assembly 104, but rather is merely physically positioned in the receptacle assembly 104 for other purposes, such as for plugging the receptacle assembly 104 for EMI containment and/or EMI shielding in the communication system 100.

In the illustrated embodiment, the receptacle assembly 104 is illustrated as a single port receptacle assembly configured to receive a single pluggable module 106 (either the shielding pluggable module 106 described herein or a traditional, standard I/O pluggable connector module used for data communication). However, the receptacle assembly 104 in other embodiments may be a multi-port receptacle assembly configured to receive pluggable modules 106 in multiple ports. For example, the multiple ports of the receptacle assembly 104 may be ganged side-by-side and/or stacked vertically.

The receptacle assembly 104 includes a cage member 108 that is mounted to the circuit board 102. The cage member 108 may be arranged at a bezel or panel 109 of a chassis of a device (not shown), such as through an opening 113 in the panel 109. As such, at least a majority of the cage member 108 is interior of the device (and the corresponding panel 109). The pluggable module 106 is loaded into the cage member 108 in a loading direction 111 from outside or exterior of the device (and the corresponding panel 109). Optionally, the panel 109 may include a plurality of openings 113 each configured to receive a corresponding pluggable module 106. In other various embodiments, the opening 113 in the panel 109 may be sized to receive multiple pluggable modules 106, such as when a multi-port receptacle assembly 104 is used.

The cage member 108 includes a front end 110 and an opposite rear end 112. The front end 110 may be provided at, and optionally extends through, the opening 113 in the panel 109. As used herein, relative or spatial terms such as "front," "back," "rear," "top," and "bottom" are used to distinguish the referenced elements and do not necessarily require particular positions or orientations in the communication system 100 or in the surrounding environment of the communication system 100. For example, the front end 110 may be located in or facing a back portion of a larger telecommunication system or device, such as a server or a computer. In many applications, the front end 110 is viewable to an operator when the operator is inserting the pluggable module 106 into the receptacle assembly 104. The pluggable module 106 within the receptacle assembly 104 is viewable and accessible to the operator to allow the operator to remove the pluggable module 106 from the receptacle assembly 104 when desirable, such as when the shielding pluggable module 106 is to be replaced in the cage member 108 by an I/O pluggable connector module.

The cage member 108 is configured to contain or shield against electromagnetic interference (EMI) that may negatively affect electrical performance of the communication system 100. The cage member 108 also guides the pluggable module 106 during loading and unloading of the pluggable module 106. The cage member 108 includes multiple pieces assembled together to enclose the pluggable module 106. For example, the pieces may be snap-fit together and/or welded together. When the cage member 108 is mounted to the circuit board 102, the cage member 108 may be electrically connected to the circuit board 102 and, in particular, to ground planes (not shown) within the circuit board 102 for electrically grounding the cage member 108. As such, the receptacle assembly 104 may reduce EMI transmission across the cage member 108. The shielding pluggable module 106 may be used to block or plug the cage member 108 in the receptacle assembly 104 to provide additional EMI containment and/or shielding, such as by plugging the opening 113 in the panel 109.

In an embodiment, the cage member 108 defines a housing that includes a plurality of panels or walls 116, which may be formed from one or more pieces. The various walls 116 provide shielding for vulnerable areas of other components, such as by covering or shielding openings in the walls 116 of the other components. Side walls 116 extend from the front end 110 to the rear end 112 of the cage member 108. One end wall 116 is disposed at the rear end 112. The walls 116 are formed from conductive material, such as sheet metal and/or a polymer having conductive particles. In the illustrated embodiment, the walls 116 are stamped and formed from sheet metal. In some embodiments, the cage member 108 is configured to facilitate airflow through the cage member 108 to transfer heat (or thermal energy) away from the receptacle assembly 104, such as via air holes 117 defined in at least one of the side walls 116. The air holes 117 may be sized to limit or reduce EMI leakage through the cage member 108. Fans or other air moving devices may be used to increase airflow through the cage member 108.

The cage member 108 defines a module cavity 120 extending between the front and rear ends 110, 112. The module cavity 120 receives the pluggable module 106. The module cavity 120 extends lengthwise along a cavity axis 114, and the loading direction 111 of the pluggable module 106 is parallel to the cavity axis 114. For a multi-port receptacle assembly 104, multiple module cavities 120 or ports are defined for receiving multiple pluggable modules 106. In such embodiments, the module cavities 120 may be stacked vertically and/or ganged horizontally.

The communication connector 122 (shown in phantom in FIG. 1) of the receptacle assembly 104 has a mating interface 124 for mating with an I/O pluggable connector module. Optionally, the mating interface 124 does not engage the shielding pluggable module 106. The communication connector 122 may have multiple mating interfaces when configured to mate with multiple I/O pluggable connector modules, such as when used in a stacked cage member. The communication connector 122 is disposed at a rear end of the module cavity 120 at or near the rear end 112 of the cage member 108. The communication connector 122 includes electrical contacts (not shown) that are configured to be mated with an I/O pluggable connector module. In an embodiment, the electrical contacts of the communication connector 122 do not engage the shielding pluggable module 106, as the shielding pluggable module 106 is not configured for data communication and lacks electrical contacts. The communication connector 122 is configured to be mounted and electrically connected to the circuit board 102. The communication connector 122 may be received in the module cavity 120 through a bottom 126 of the cage member 108. For example, the cage member 108 is configured to be mounted to the circuit board 102 by lowering the cage member 108 over the communication connector 122 such that the communication connector 122 passes through an opening in the bottom 126 as the cage member 108 is mounted to the circuit board 102.

In an exemplary embodiment, the module cavity 120 includes an airflow channel 128 that allows airflow through the module cavity 120. For example, in the illustrated embodiment, the airflow channel 128 is positioned along a top portion of the module cavity 120 and passes along the top of the pluggable module 106 to cool the pluggable module 106 and/or other components in the communication system. In an exemplary embodiment, the airflow channel 128 is open at the front end 110 and at the rear end 112 to allow airflow through the module cavity 120 along the pluggable module 106. The airflow channel 128 is fluidly connected to the air holes 117 or vents along the side wall(s) 116 of the cage member 108.

The shielding pluggable module 106 is used for shielding components of the communication system 100, such as components of the receptacle assembly 104 and/or the circuit board 102, from EMI and/or debris and other contaminants that could enter the device through the opening 113 in the panel 109. The shielding pluggable module 106 may also be used to provide EMI containment within the communication system 100, such as to prohibit EMI generated within the cage member 108 from leaking out of the cage member 108 within the device and/or leaking out of the device through the opening 113 in the panel 109. The shielding pluggable module 106 in an embodiment is composed of an electrically conductive material to block the transmission of EMI through the module cavity 120. As described above, the shielding pluggable module 106 may be used in place of an I/O connector module, such as a small form-factor pluggable (SFP) transceiver or quad small form-factor pluggable (QSFP) transceiver satisfying certain technical specifications for SFP or QSFP transceivers, such as Small-Form Factor (SFF)-8431. By way of example, the shielding pluggable module 106 may be used in place of transceivers which are part of the SFP+ product family available from TE Connectivity. The shielding pluggable module 106 has a form factor that complements the form factor of the I/O connector modules such that the shielding pluggable module 106 may be plugged into the receptacle assembly 104 in the same manner as the I/O connector modules. The form factor of the shielding pluggable module 106 complements the size and shape of the module cavity 120 such that the pluggable module 106 occupies most of the cross-sectional area of the module cavity 120 at the front end 110 of the cage member 108. As a result, the shielding pluggable module 106 at least partially seals or plugs the module cavity 120, except for spaces in the airflow channel 128 to allow air to flow through the cage member 108.

In an exemplary embodiment, the shielding pluggable module 106 includes a plug body 130 and a tether 132. The tether 132 is part of a releasable latching mechanism of the shielding pluggable module 106. The plug body 130 is fully loaded within the module cavity 120 in FIG. 1, although a portion including a front end 136 of the plug body 130 protrudes outward from the cage member 108 in front of the panel 109 of the device, and is accessible to an operator. The front end 136 of the pluggable module 106 includes a solid front wall 137, and unlike a conventional I/O connector module does not have a cable extending therefrom.

The tether 132 has a handle 134 that is outside of the cage member 108 and outside of the device (for example, in front of the panel 109). The handle 134 is exposed for manipulation by an operator. In an embodiment, the handle 134 is manipulated by the operator to selectively remove the pluggable module 106 from the cage member 108. For example, movement of the handle 134 in a frontward direction 138 is configured to release a latching feature of the plug body 130 from engagement with a catch feature of the cage member 108 to allow the operator to pull the pluggable module 106 out of the module cavity 120. The pluggable module 106 may be removed from the cage member 108 to substitute the shielding pluggable module 106 for an I/O connector module or a testing pluggable module, or to disassemble the communication system 100. The frontward direction 138 may be parallel to the cavity axis 114 and opposite in direction to the loading direction 111 of the pluggable module 106. In an embodiment, the tether 132 is flexible and can accommodate the handle 134 being pulled by the operator in various directions that deviate from the frontward direction 138 as long as the direction of pull includes a vector component along the frontward direction 138. For example, the pluggable module 106 could still be released from the cage member 108 if the handle 134 is pulled vertically upwards or downwards as long as there is sufficient tension in the tether to deflect the deflectable beam.

Although the embodiments shown and described herein are directed to a shielding pluggable module 106, the releasable latching mechanisms of the shielding pluggable module 106 could be used on other specialty pluggable modules, such as testing pluggable modules, or even on I/O pluggable connector modules. The testing pluggable modules are used for testing components of the circuit board 102 and/or the receptacle assembly 104, such as the communication connector 122. For example, a testing pluggable module may include sensors for monitoring temperature within the module cavity 120, electrical characteristics of the communication connector 122 such as voltage, current, impedance, and/or resistance, or the like. Therefore, the releasable latching mechanisms described herein are not necessarily limited to implementation in shielding pluggable modules, but may be used for other pluggable modules configured to be removably loaded into receptacle assemblies similar to the receptacle assembly 104.

Figure 2:
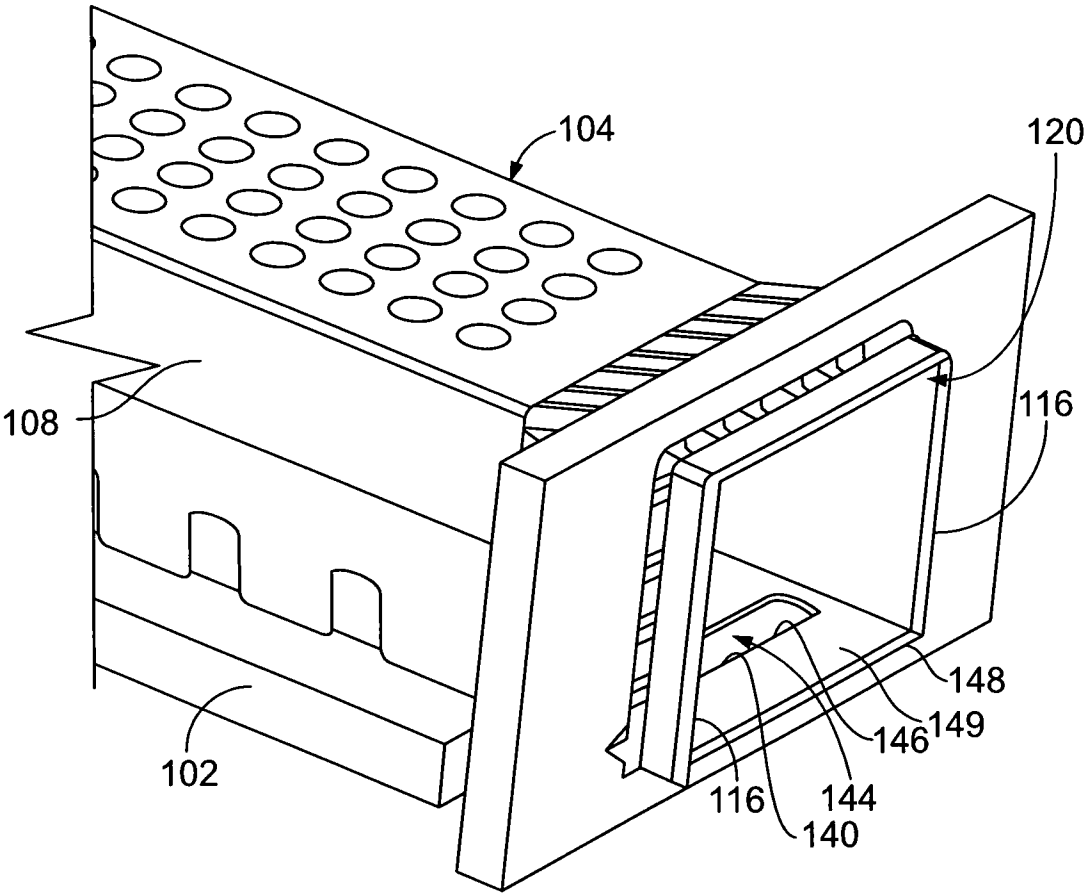
FIG. 2 is a front perspective view of a portion of a receptacle assembly of the communication system mounted to a circuit board according to an embodiment.

FIG. 2 is a front perspective view of a portion of the receptacle assembly 104 mounted to the circuit board 102 according to an embodiment. The cage member 108 of the receptacle assembly 104 includes a catch feature 140 that is configured to engage a complementary catch feature 150 (shown in FIG. 3) of the pluggable module 106 (shown in FIG. 1) when the pluggable module 106 is loaded in the module cavity 120. The engagement of the catch features 140, 150 secures and retains the pluggable module 106 within the module cavity 120. In the illustrated embodiment, the catch feature 140 of the cage member 108 is a rear-facing surface of an aperture 144 defined in a bottom wall 148 of the of the cage member 108. The rear-facing catch surface 140 is located along a front edge 146 of the aperture 144. The aperture 144 may be a depression or groove defined along an inner surface 149 of the bottom wall 148 that faces the module cavity 120 or may extend fully through an entire thickness of the bottom wall 148. In an alternative embodiment, instead of the aperture 144 extending at least partially through the bottom wall 148, a plate or insert may be coupled to the bottom wall 148 within the module cavity 120, and the aperture 144 is defined as the space rearward of a rear edge of the plate. Although the catch feature 140 is located along the bottom wall 148 in the illustrated embodiment, the catch feature 140 may be located along a different wall 116 of the cage member 108 in an alternative embodiment. Furthermore, only one elongated aperture 144 is shown in FIG. 2, but in alternative embodiments the cage member 108 may include multiple apertures 144 defining multiple catch features 140. In yet another alternative embodiment, the catch feature 140 may be a rear-facing surface of a protrusion that extends from the bottom wall 148 (or another wall 116) into the module cavity 120, instead of a surface of an aperture 144.

Figure 3:
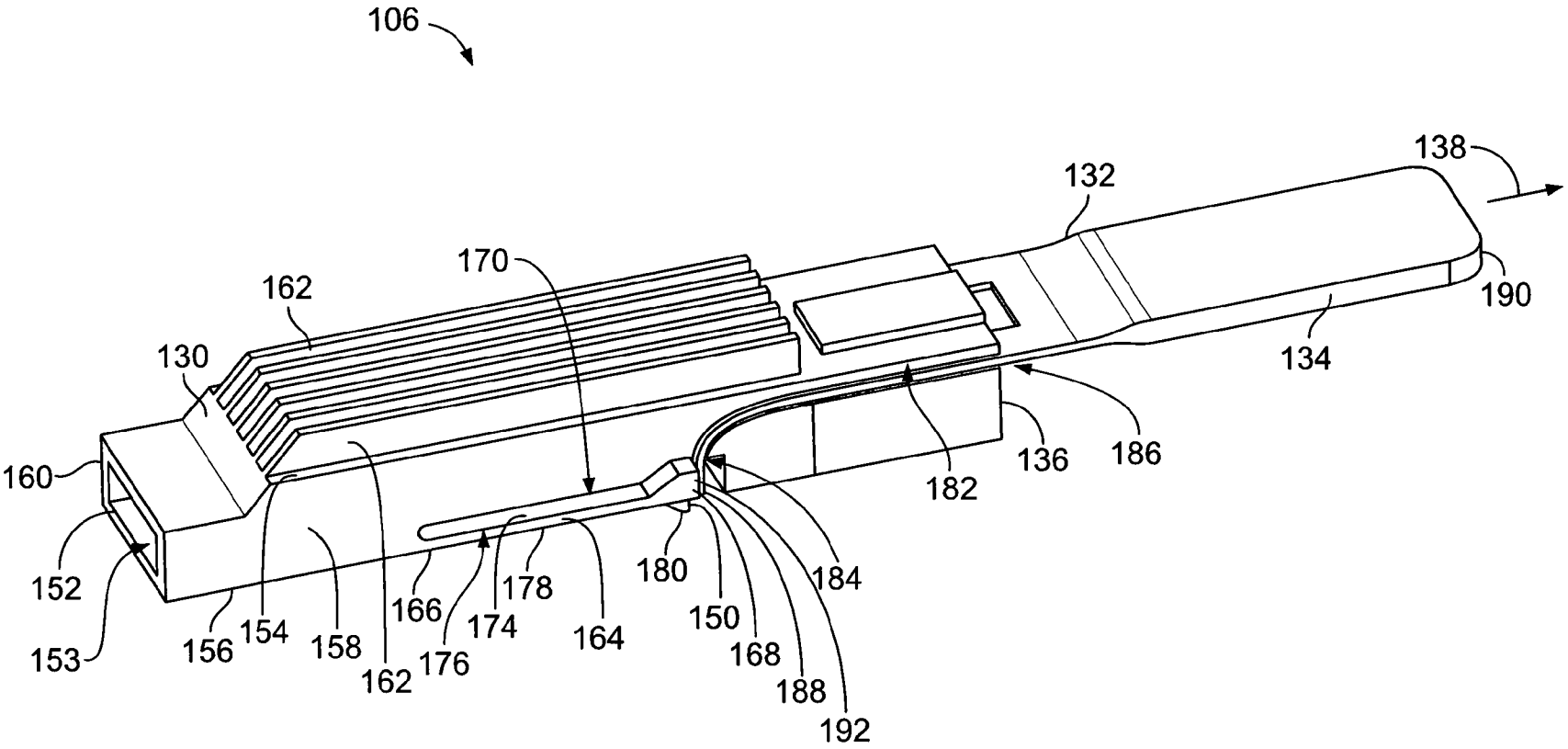
FIG. 3 is a rear perspective view of a pluggable module of the communication system in accordance with an embodiment.

FIG. 3 is a rear perspective view of the shielding pluggable module 106 in accordance with an exemplary embodiment. The plug body 130 extends between the front end 136 and an opposite rear end 152. The rear end 152 is configured to be inserted into the module cavity 120 (shown in FIG. 2). In the illustrated embodiment, the rear end 152 defines an opening to a socket 153. The socket 153 is configured to receive the mating interface 124 (shown in FIG. 1) of the communication connector 122 (FIG. 1) therein. For example, the mating interface 124 may define a shroud that is received within the socket 153 when the pluggable module 106 is fully loaded within the module cavity 120. The pluggable module 106 lacks or is devoid of electrical contacts within the socket 153, so the pluggable module 106 does not electrically connect with the communication connector 122. In an alternative embodiment, the rear end 152 of the pluggable module 106 may be closed, such that the rear end 152 includes a solid rear wall. In such an alternative embodiment, the rear wall may be spaced apart from the communication connector 122 when the plug body 130 is fully loaded within the module cavity 120.

In an embodiment, the plug body 130 is composed of an electrically conductive material, such as one or more metals, a conductive polymer, or a lossy material having metal particles suspended in a low loss dielectric material, such as an epoxy. The one or more metals may include zinc and/or aluminum, for example. The electrically conductive material allows the plug body 130 to provide EMI containment and/or EMI shielding within the module cavity 120 (shown in FIG. 2). The plug body 130 may be formed via a casting or molding process, such as die-casting, insert molding, or the like. In an alternative embodiment, the plug body 130 may be extruded. The plug body 130 includes outer walls that extend between the front and rear ends 136, 152 and define at least portions of an outer perimeter of the plug body 130. The outer walls include a top wall 154, a bottom wall 156, and opposite side walls 158, 160.

In the illustrated embodiment, the plug body 130 includes a plurality of heat transfer fins 162 extending along the top wall 154. The fins 162 transfer heat from the module cavity 120 (shown in FIG. 2), such as heat generated from the pluggable module 106, out of the device through the air holes 117 (FIG. 1). The fins 162 are separated by gaps that allow airflow or other cooling flow along the surfaces of the fins 162 to dissipate the heat therefrom. In the illustrated embodiment, the fins 162 are parallel plates that extend lengthwise, but the fins 162 may have other shapes in alternative embodiments, such as cylindrical posts, tear-shaped posts, wavy plates, or the like.

The plug body 130 includes a deflectable beam 164 that is cantilevered relative to the plug body 130. The deflectable beam 164 extends between a fixed end 166 that is fixed to the plug body 130, and a free end 168 that is spaced apart from the plug body 130. The free end 168 is spaced apart from an outer wall of the plug body 130 by a clearance gap 170. The deflectable beam 164 is configured to pivot, bend, or deflect about the fixed end 166, such that the free end 168 moves into the clearance gap 170 towards the outer wall. In the illustrated embodiment the deflectable beam 164 extends from the bottom wall 156 of the plug body 130, and the clearance gap 170 is defined between the bottom wall 156 and an inner side 174 of the deflectable beam 164. For example, the deflectable beam 164 extends into a recess 176 defined along the bottom wall 156. The fixed end 166 of the deflectable beam 164 is located at a back of the recess 176 and the deflectable beam 164 extends frontward towards the front end 136. In the illustrated embodiment an outer side 178 of the deflectable beam 164 is generally planar with portions of the bottom wall 156 of the plug body 130 on either side of the recess 176. When the plug body 130 is loaded into the module cavity 120, the bottom wall 156 of the plug body and the outer side 178 of the deflectable beam 164 may slide along the bottom wall 148 (shown in FIG. 2) of the cage member 108 (FIG. 2). The clearance gap 170 is disposed vertically above the free end 168, and the deflection of the deflectable beam 164 moves the free end 168 vertically upwards into the clearance gap 170, reducing the height of the gap 170 between the beam 164 and the plug body 130.

In an embodiment, the deflectable beam 164 has a width that extends an entire width of the plug body 130 between the two side walls 158, 160. In an alternative embodiment, the deflectable beam 164 that is shown in FIG. 3 may be one of at least two deflectable beams 164 disposed side by side along the width of the plug body 130. For example, the illustrated deflectable beam 164 proximate to the first side wall 158 may be a first beam, and a second beam (not shown) spaced apart from the first beam may be located proximate to the second side wall 160. Although the illustrated embodiment shows the deflectable beam 164 coupled to and extending from the bottom wall 156 of the plug body 130, in other embodiments the deflectable beam 164 may be coupled to one of the side walls 158, 160 instead of the bottom wall 156.

In an embodiment, the deflectable beam 164 is integral to the plug body 130, such that the plug body 130 and the deflectable beam 164 comprise a unitary one-piece structure. The deflectable beam 164 is integrally connected to the plug body 130 such that the deflectable beam 164 cannot be removed from the plug body 130 without damaging the beam 164 and/or the plug body 130. For example, the deflectable beam 164 may be formed simultaneously with the plug body 130 in the same process, such as in a same die-casting or molding operation. Constructing the plug body 130 with an integral deflectable beam 164 may reduce the number of different components that are assembled together, which can reduce the cost of the pluggable module 106 relative to conventional pluggable modules that include more components and assembly steps. In another example, the deflectable beam 164 may be integrally connected to the plug body 130 subsequent to formation via welding or another permanent joining process. In an alternative embodiment, the deflectable beam 164 is not integral to the plug body 130, but rather may be non-permanently attached to the plug body 130 via a fastener, an adhesive, or the like.

The deflectable beam 164 includes the catch feature 150 that is configured to engage the catch feature 140 (shown in FIG. 2) of the cage member 108 (FIG. 2) to secure the pluggable module 106 in the module cavity 120 (FIG. 2). The catch feature 150 is located on or at least proximate to the free end 168. In the illustrated embodiment, the catch feature 150 is a front-facing surface of a protrusion 180 that extends from the outer side 178 of the deflectable beam 164. The protrusion 180 may be a tooth, a tab, a ridge, or the like. The protrusion 180 projects downward from the outer side 178 to be received in the aperture 144 (FIG. 2) of the bottom wall 148 (FIG. 2). Although only one protrusion 180 is visible in FIG. 3, the deflectable beam 164 in an embodiment includes at least two protrusions 180 spaced apart laterally along a width of the beam 164, such that one protrusion 180 is proximate to the first side 158 and another protrusion 180 is proximate to the second side 160. Alternatively, a single protrusion 180 may extend laterally across a majority of the width of the plug body 130 between the two side walls 158, 160.

The plug body 130 defines a tether channel 182 extending through the plug body 130. The tether channel 182 is connected to the clearance gap 170 at a first opening 184 and extends frontward from the first opening 184 to a second opening 186. In the illustrated embodiment, the second opening 186 is defined along the front wall 137 (shown in FIG. 1) of the plug body 130 at the front end 136. Alternatively, the second opening 186 may be located along the top wall 154 in front of the fins 162. The tether channel 182 does not extend across the entire width of the plug body 130 between the side walls 158, 160. In an embodiment, the plug body 130 defines a first tether channel 182 extending along or proximate to the first side wall 158 and a second tether channel 182 (partially shown in FIG. 1) along or proximate to the second side wall 160. The two tether channels 182 extend parallel to each other. As shown in FIG. 1, a central portion 131 of the plug body 130 is disposed laterally between the two tether channels 182 to maintain the connection between a top/rear portion of the plug body 130 and a bottom/front portion of the plug body 130 on either side of the tether channels 182.

The tether 132 is disposed within the tether channel 182. The tether 132 extends from a mounting end 188 to a user end 190. The mounting end 188 is secured to the deflectable beam 164 at or near the free end 168. For example, a segment of the tether 132 including the mounting end 188 protrudes from the first opening 184 across the clearance gap 170 and couples to the deflectable beam 164. In the illustrated embodiment, the tether 132 couples to a front edge 192 of the beam 164 at the free end 168. At the other end of the tether 132, a segment including the user end 190 protrudes from the second opening 186 and extends frontward beyond the front end 136 of the plug body 130. The handle 134 of the tether 132 is disposed outside of the tether channel 182 and defines the user end 190. In the illustrated embodiment, the tether channel 182 is open along the first side wall 158 of the plug body 130 for an entire length of the tether channel 182. The open side of the tether channel 182 may support the routing of the tether 132 through the tether channel 182 during assembly of the pluggable module 106.

Figure 7:
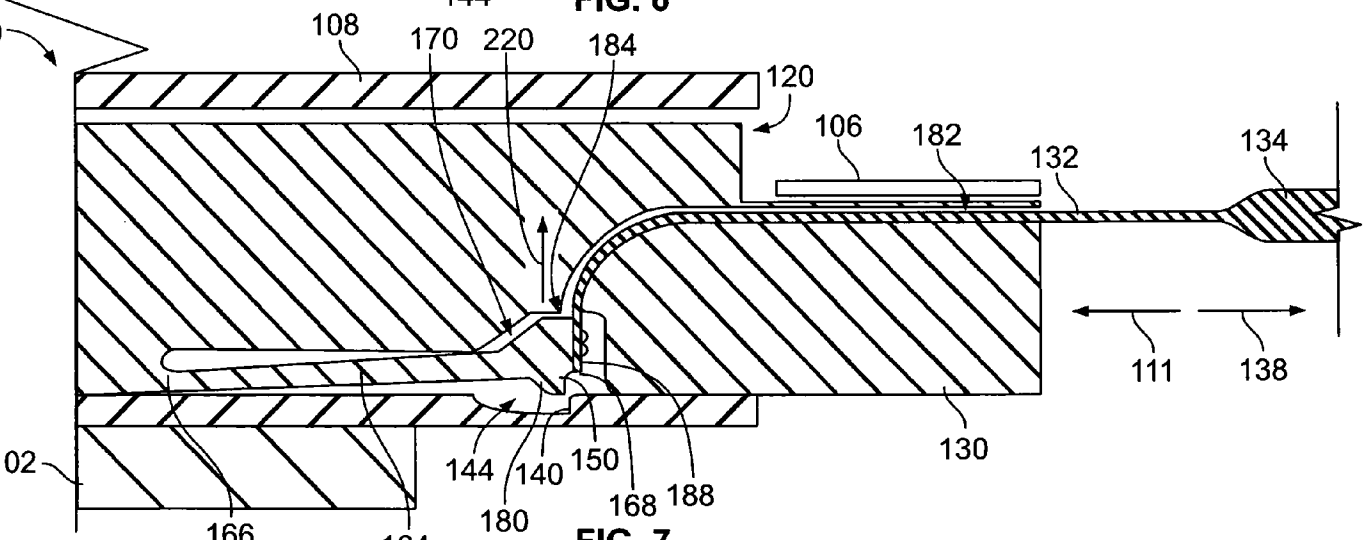
FIG. 7 is a side cross-sectional view of the portion of the communication system of FIG. 6 showing the pluggable module in an unlatched position relative to the cage member.

In an embodiment, movement of the handle 134 by the operator in the frontward direction 138 puts tension on the tether 132. The mounting end 188 of the tether 132 pulls the deflectable beam 164 towards the first opening 184 of the tether channel 182, which deflects (for example, pivots or bends) the beam 164 into the clearance gap 170 (located between the beam 164 and the first opening 184). The deflection of the beam 164 lifts the free end 168, and the catch feature 150 thereof, to a lifted position, as shown in FIG. 7, which allows the catch feature 150 to disengage and move relative to the catch feature 140 (shown in FIG. 2) of the cage member 108 (FIG. 2) for removing the pluggable module 106 from the module cavity 120 (FIG. 2). In the illustrated embodiment in which the beam 164 is an integral member of the plug body 130, the pluggable module 106 is composed of only the plug body 130 and the tether 132. Therefore, the pluggable module 106 with an integrated releasable latching mechanism is assembled by routing the tether 132 through the tether channel 182 and securing the tether 132 to the beam 164. The pluggable module 106 may have fewer discrete components and/or fewer, less complex assembly steps than conventional shielding pluggable modules. As a result, the pluggable module 106 may be less costly to produce, more reliable, and/or cheaper to repair than conventional shielding pluggable modules.

Figure 4:
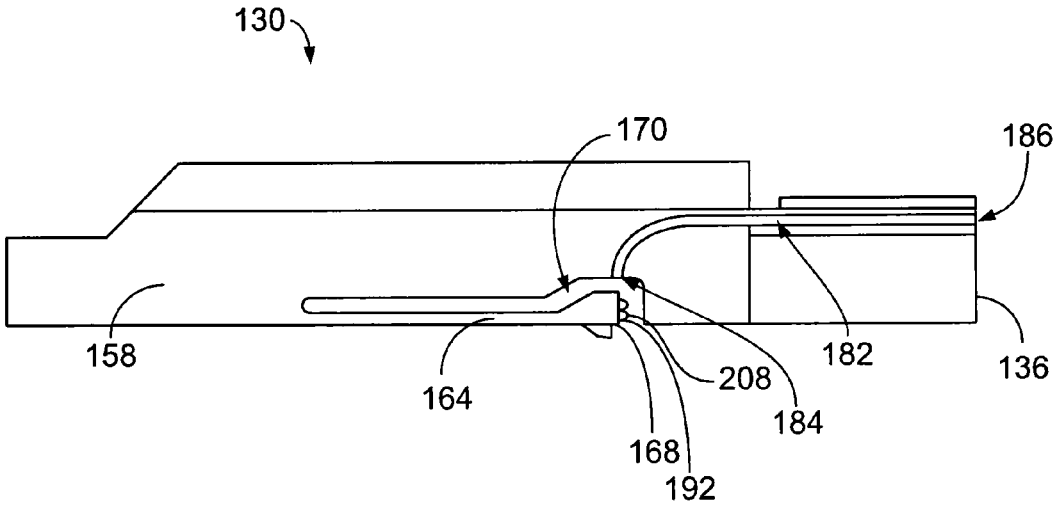
FIG. 4 is a side view of a plug body of the pluggable module according to an embodiment.

FIG. 4 is a side view of the plug body 130 of the shielding pluggable module 106 (shown in FIG. 3) according to an embodiment. Although only the tether channel 182 located along the side wall 158 is visible in FIG. 4, the description of the tether channel 182 may apply to the other tether channel 182 (shown in FIG. 1) located along the side wall 160 (FIG. 3). The tether channel 182 extends along a curved path through the plug body 130 between the first opening 184 at the clearance gap 170 and the second opening 186 at the front end 136 of the plug body 130. Optionally, the curved path may include an approximately 90-degree curve between the first and second openings 184, 186. For example, due to the 90-degree curve, a cross-sectional plane of the first opening 184 may be approximately orthogonal relative to a cross-sectional plane of the second opening 186. In other embodiments, the curved path may define a curve of more or less than 90 degrees, such as an 80-degree curve or a 100-degree curve between the first and second openings 184, 186. As shown in FIG. 4, the first opening 184 of the tether channel 182 aligns vertically above the free end 168 of the deflectable beam 164, with the clearance gap 170 located therebetween.

Figure 5:
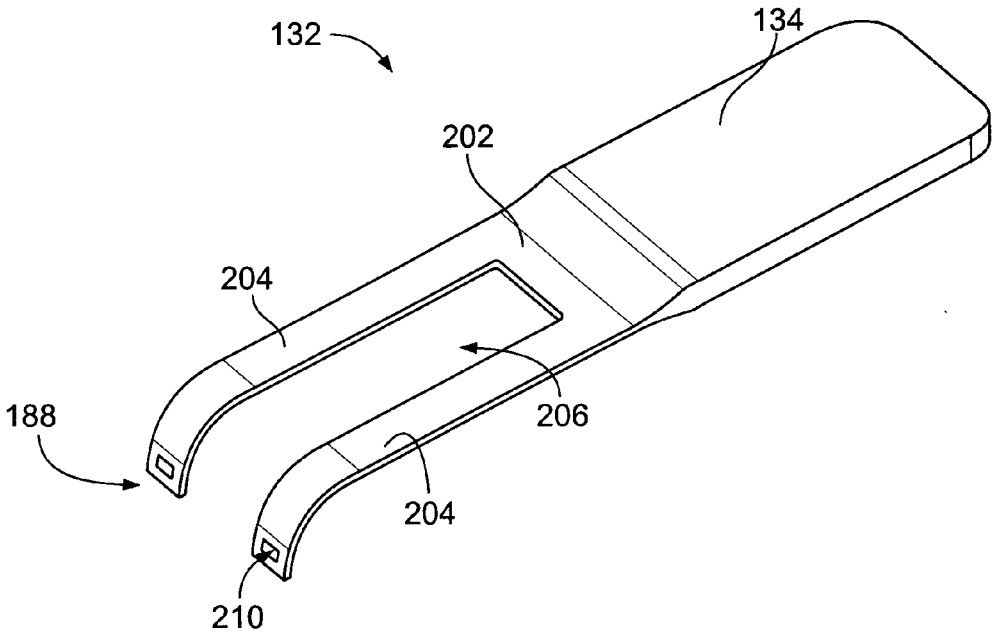
FIG. 5 is a rear perspective view of a tether of the pluggable module according to an embodiment.

FIG. 5 is a rear perspective view of the tether 132 of the shielding pluggable module 106 (shown in FIG. 3) according to an embodiment. The tether 132 includes the handle 134 and a strap 202 that extends from the handle 134 to the mounting end 188. The strap 202 includes a pair of bands or arms 204 that are spaced apart laterally from each other by a strap opening 206. The arms 204 extend in a common direction from the handle 134 to the mounting end 188. The arms 204 are relatively thin to fit within the tether channels 182 (shown in FIG. 3). The tether 132 may be composed of various materials, such as one or more metals and/or plastics. For example, the strap 202 may be composed of a sheet of metal, and the handle 134 may include metal that is overmolded with a dielectric material. In another embodiment, the entire tether 132 is composed of a dielectric material, such as a flexible and/or rubber-like plastic. In yet another embodiment, the tether 132 may be composed of strands of metal or other fibers that are braided or otherwise woven together.

Referring now to both FIGS. 4 and 5, the arms 204 of the tether 132 at the mounting end 188 are attached to the deflectable beam 164 via fasteners, adhesives, soldering, and/or the like, to secure the tether 132 to the beam 164. In the illustrated embodiment, the deflectable beam 164 includes mounting projections 208 that are configured to be received within corresponding mounting apertures 210 of the arms 204 of the tether 132. Only one mounting projection 208 is visible in FIG. 4. The mounting projection 208 extends frontward from the front edge 192 of the deflectable beam 164, but may be located on other surfaces of the beam 164 in other embodiments. As shown in FIG. 4, the mounting projection 208 aligns vertically with the first opening 184 of the tether channel 182, such that the tether 132, when secured to the mounting projection 208, extends generally vertically between the first opening 184 and the mounting projection 208 across the clearance gap 170. The mounting projection 208 may be a post (such as a ball-eye post), multiple prongs, a tab, or the like, that is received through the corresponding mounting aperture 210 and engages a back side of the arm 204 to secure the mounting projection 208 within the mounting aperture 210. In an alternative embodiment, the tether 132 includes a mounting projection that is received into an aperture in the deflectable beam 164 or engages a complementary fastener on the beam 164 to secure the tether 132 to the beam 164.

Figure 6:
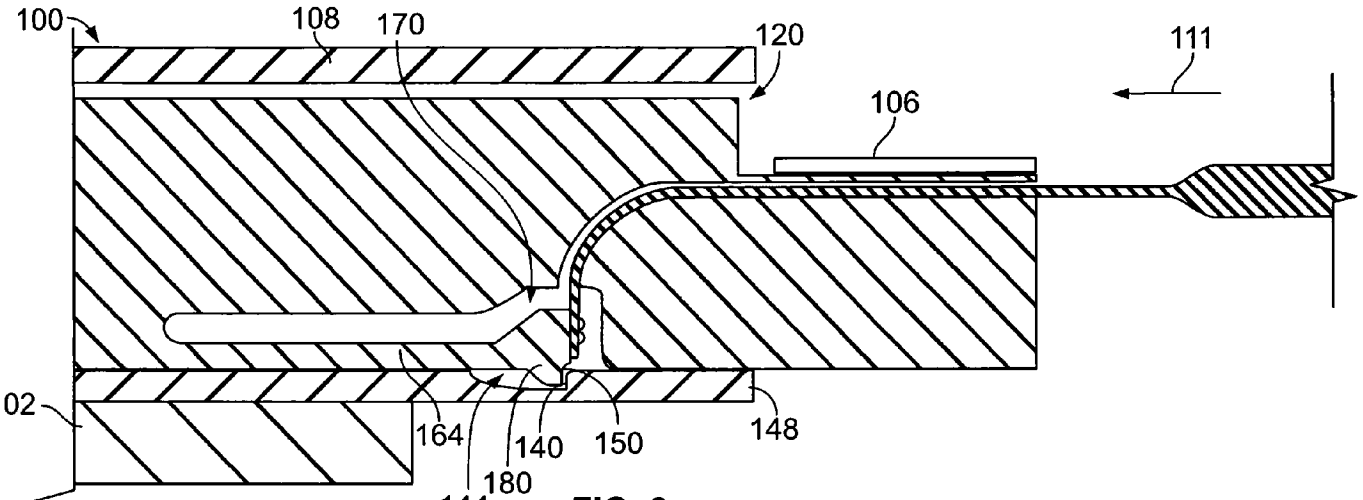
FIG. 6 is a side cross-sectional view of a portion of the communication system showing the pluggable module in a latched position relative to a cage member.

FIG. 6 is a side cross-sectional view of a portion of the communication system 100 showing the shielding pluggable module 106 in a latched position relative to the cage member 108. FIG. 7 is a side cross-sectional view of the portion of the communication system 100 of FIG. 6 showing the shielding pluggable module 106 in an unlatched position relative to the cage member 108. The pluggable module 106 is fully loaded within the module cavity 120 of the cage member 108 in both FIGS. 6 and 7, such that the axial position of the pluggable module 106 relative to the cage member 108 and the circuit board 102 does not change.

Referring to FIG. 6, when the pluggable module 106 is initially loaded into the module cavity 120 in the loading direction 111, the protrusion 180 engages the bottom wall 148 of the cage member 108, which forces the deflectable beam 164 to deflect into the clearance gap 170. Once the catch feature 150 of the beam 164 moves (in the loading direction 111) beyond the catch feature 140 of the cage member 108, the deflectable beam 164 resiles towards an undeflected position and the protrusion 180 is received into the aperture 144. The protrusion 180 entering into the aperture 144 represents the pluggable module 106 attaining the latched position because, thereafter, frontward movement of the pluggable module 106 out of the module cavity 120 is obstructed by the catch features 140, 150 abutting against one another. Thus, the pluggable module 106 is secured within the module cavity 120 when in the latched position shown in FIG. 6.

Referring now to FIG. 7, the pluggable module 106 is removable from the module cavity 120 when in the unlatched position, which is characterized by the deflectable beam 164 deflecting into the clearance gap 170 such that the protrusion 180 is outside of the aperture 144. In the illustrated embodiment, the tether 132 pulls the free end 168 of the deflectable beam 164 into the clearance gap 170 responsive to the handle 134 being moved by an operator in the frontward direction 138. For example, the movement of the handle 134 puts tension in the tether 132, and the mounting end 188 of the tether 132 attached to the beam 164 is pulled towards the first opening 184 of the tether channel 182. The pull of the tether 132 moves the free end 168 of the beam 164 in an unlatching direction 220 into the clearance gap 170. The free end 168 is deflected a sufficient distance such that the protrusion 180 exits the aperture 144. For example, the free end 168 moves farther than a height of an overlapping area between the catch features 140, 150. The unlatching direction 220 is illustrated as being generally linear, although the movement has a slight (for example, negligible) amount of curve due to the deflectable beam 164 pivoting about the fixed end 166. In an embodiment, the unlatching direction 220 is generally orthogonal to the frontward direction 138 (and the loading direction 111). In the illustrated embodiment, the unlatching direction 220 is vertically upwards. With the protrusion 180 lifted out of the aperture 144, the pluggable module 106 has an unobstructed path out of the module cavity 120. The operator may grasp the plug body 130 or may continue pulling the handle 134 of the tether 132 to pull the pluggable module 106 frontward out of the module cavity 120.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. §112(f), unless and until such claim limitations expressly use the phrase "means for" followed by a statement of function void of further structure.

What is claimed is:

1. A pluggable module comprising:

a plug body extending between a front end and an opposite rear end, the rear end removably receivable in a module cavity of a cage member;

a deflectable beam extending between a fixed end that is fixed to the plug body and a free end that is spaced apart from an outer wall of the plug body by a clearance gap, the deflectable beam including a catch feature configured to engage a complementary catch feature of the cage member to secure the pluggable module in the module cavity; and a tether disposed within a tether channel of the plug body that extends through the plug body to the clearance gap, the tether having a mounting end secured to the deflectable beam and a handle projecting beyond the front end of the plug body, wherein movement of the handle in a frontward direction deflects the deflectable beam into the clearance gap such that the catch feature of the deflectable beam is moved for disengaging the complementary catch feature of the cage member to allow the pluggable module to be removed from the module cavity.

2. The pluggable module of claim 1, wherein the plug body is composed of an electrically conductive material such that the pluggable module within the module cavity provides at least one of electromagnetic interference (EMI) containment or EMI shielding.

3. The pluggable module of claim 1, wherein the rear end of the plug body defines a socket that is configured to receive a portion of a communication connector therein, the communication connector disposed within the cage member proximate to a rear end of the module cavity, wherein the socket lacks electrical contacts therein and the pluggable module does not electrically connect to the communication connector.

4. The pluggable module of claim 1, wherein the tether channel extends along a curved path through the plug body between a first opening at the clearance gap and a second opening at the front end of the plug body.

5. The pluggable module of claim 4, wherein the curved path includes an approximately 90-degree curve.

6. The pluggable module of claim 1, wherein, responsive to the movement of the handle in the frontward direction, the free end of the deflectable beam moves in an unlatching direction generally orthogonal to the frontward direction of the handle.

7. The pluggable module of claim 1, wherein the deflectable beam is integral to the plug body such that the plug body and the deflectable beam comprise a unitary, one-piece structure.

8. The pluggable module of claim 1, wherein the catch feature of the deflectable beam is a front-facing surface of a protrusion that extends outward from the deflectable beam and the complementary catch feature of the cage member is a rear-facing surface of an aperture defined in a wall of the cage member, the protrusion received in the aperture when the pluggable module is loaded within the module cavity.

9. The pluggable module of claim 1, wherein the deflectable beam is disposed vertically below the clearance gap between the plug body and the free end of the deflectable beam, the tether channel is open to the clearance gap at a first opening that is vertically above the free end of the deflectable beam, wherein the tether pulls the free end of the deflectable beam vertically upwards into the clearance gap towards the first opening responsive to the handle moving in the frontward direction.

10. The pluggable module of claim 1, wherein the deflectable beam has an inner side and an opposite outer side, the inner side facing the clearance gap, the catch feature of the deflectable beam located on the outer side.

11. The pluggable module of claim 1, wherein the plug body is receivable in the module cavity of the cage member in a loading direction, the frontward direction of the handle being opposite to the loading direction, the tether moving the free end of the deflectable beam in an unlatching direction that is generally orthogonal to the loading direction responsive to the handle moving in the frontward direction.

12. A pluggable module comprising:

a plug body extending between a front end and an opposite rear end, the rear end removably receivable in a module cavity of a cage member;

a deflectable beam extending between a fixed end that is fixed to the plug body and a free end that is spaced apart from an outer wall of the plug body by a clearance gap, the deflectable beam including a catch feature configured to engage a complementary catch feature of the cage member to secure the pluggable module in the module cavity; and a tether disposed within a tether channel of the plug body that extends along a curved path through the plug body between a first opening at the clearance gap and a second opening at least proximate to the front end of the plug body, the tether having a mounting end extending from the first opening and secured to the deflectable beam, the tether further including a handle extending from the plug body at the second opening, wherein movement of the handle in a frontward direction deflects the deflectable beam into the clearance gap such that the catch feature of the deflectable beam is moved for disengaging the complementary catch feature of the cage member to allow the pluggable module to be removed from the module cavity.

13. The pluggable module of claim 12, wherein the curved path of the tether channel includes an approximately 90-degree curve between the first and second openings.

14. The pluggable module of claim 12, wherein the deflectable beam is integral to the plug body such that the plug body and the deflectable beam comprise a unitary, one-piece structure.

15. The pluggable module of claim 12, wherein the deflectable beam has an inner side and an opposite outer side, the inner side facing the clearance gap, the catch feature of the deflectable beam located on the outer side.

16. The pluggable module of claim 12, wherein the clearance gap is disposed between the first opening of the tether channel and the free end of the deflectable beam, wherein the tether pulls the free end of the deflectable beam into the clearance gap towards the first opening responsive to the movement of the handle in the frontward direction.

17. A pluggable module comprising:

a plug body extending between a front end and an opposite rear end, the rear end removably receivable in a module cavity of a cage member, the plug body including a deflectable beam that is integral to the plug body, the deflectable beam extending from the plug body between a fixed end attached to the plug body and a free end spaced apart from an outer wall of the plug body by a clearance gap, the deflectable beam including a catch feature that is configured to engage a complementary catch feature of the cage member to secure the pluggable module in the module cavity; and a tether disposed within a tether channel of the plug body that extends through the plug body to the clearance gap, the tether having a mounting end secured to the deflectable beam and a handle projecting beyond the front end of the plug body, wherein movement of the handle in a frontward direction deflects the deflectable beam into the clearance gap such that the catch feature of the deflectable beam is moved for disengaging the complementary catch feature of the cage member to allow the pluggable module to be removed from the module cavity.

18. The pluggable module of claim 17, wherein the plug body is composed of an electrically conductive material such that the pluggable module within the module cavity provides at least one of electromagnetic interference (EMI) containment or EMI shielding.

19. The pluggable module of claim 17, wherein the tether channel extends along a curved path through the plug body between a first opening at the clearance gap and a second opening at the front end of the plug body.

20. The pluggable module of claim 17, wherein, responsive to the movement of the handle in the frontward direction, the free end of the deflectable beam moves in an unlatching direction generally orthogonal to the frontward direction of the handle.

* * * * *